US009082606B2

(12) United States Patent
Braun et al.

(10) Patent No.: US 9,082,606 B2
(45) Date of Patent: Jul. 14, 2015

(54) HIGH-PRESSURE DISCHARGE LAMP

(75) Inventors: Paul Braun, Nordendorf (DE); Klaus Stockwald, Germering (DE)

(73) Assignee: Osram GmbH, Munich (DE)

( * ) Notice: Subject to any disclaimer, the term of this patent is extended or adjusted under 35 U.S.C. 154(b) by 0 days.

(21) Appl. No.: 14/117,061

(22) PCT Filed: May 17, 2011

(86) PCT No.: PCT/EP2011/057991

§ 371 (c)(1),
(2), (4) Date: Nov. 12, 2013

(87) PCT Pub. No.: WO2012/155965

PCT Pub. Date: Nov. 22, 2012

(65) Prior Publication Data

US 2014/0175976 A1 Jun. 26, 2014

(51) Int. Cl.
*H01J 61/36* (2006.01)
*H01J 61/82* (2006.01)

(52) U.S. Cl.
CPC ..... *H01J 61/366* (2013.01); *H01J 61/827* (2013.01)

(58) Field of Classification Search
None
See application file for complete search history.

(56) References Cited

U.S. PATENT DOCUMENTS

| | | | | |
|---|---|---|---|---|
| 5,424,609 | A | 6/1995 | Geven et al. | |
| 6,414,451 | B1 | 7/2002 | Baake et al. | |
| 2005/0212431 | A1 | 9/2005 | Weiland et al. | |
| 2008/0284337 | A1* | 11/2008 | Hendricx | 313/625 |
| 2009/0267515 | A1* | 10/2009 | Hendricx et al. | 313/636 |
| 2010/0213860 | A1 | 8/2010 | Braun et al. | |

FOREIGN PATENT DOCUMENTS

| | | | |
|---|---|---|---|
| DE | 102007045071 | A1 | 4/2009 |
| EP | 1114438 | B1 | 12/2008 |
| WO | 03096377 | A1 | 11/2003 |
| WO | 2005124823 | A1 | 12/2005 |
| WO | 2006077516 | A2 | 7/2006 |
| WO | 2008075273 | A1 | 6/2008 |

* cited by examiner

*Primary Examiner* — Ashok Patel

(57) ABSTRACT

A high-pressure discharge lamp may include a discharge vessel, which encloses a discharge volume, wherein a filler is housed in the discharge volume, wherein the discharge vessel is equipped with an end which is tubular and in which a two-part feedthrough is sealed by means of glass solder, wherein an electrode is attached to the feedthrough, which protrudes into the discharge volume, wherein the feedthrough is composed of a front part and a rear part, wherein the rear part is manufactured from niobium material and the front part is manufactured from iridium.

10 Claims, 3 Drawing Sheets

HIGH-PRESSURE DISCHARGE LAMP

RELATED APPLICATIONS

This application is a national stage entry according to 35 U.S.C. §371 of PCT application No.: PCT/EP2011/057991 filed on May 17, 2011.

TECHNICAL FIELD

The present disclosure is directed to a high-pressure discharge lamp. It relates in particular to metal halide lamps. Such lamps are in particular high-pressure discharge lamps having ceramic discharge vessel for general illumination.

BACKGROUND

EP 1 114 438 and WO 2006/077516 and WO 2008/075273 each disclose a high-pressure discharge lamp, in which iridium is used for the seal. The feedthrough is a pin or a wire made of iridium, wherein the pin is sintered directly into the end of the ceramic discharge vessel. The wire is pushed as a coil onto a core pin. However, these concepts have not proven themselves in practice.

SUMMARY

Various embodiments provide a high-pressure discharge lamp, which has a short structural length and is simple to produce and has a service life sufficient for commercial purposes.

Long service lives in ceramic lamps have been ensured up to this point by long capillaries at the ends, in which feedthroughs are seated, which typically have a front halogen-resistant end made of molybdenum or tungsten, and which have a feedthrough made of niobium or also cermet at the rear. This technology is reliable, but it is complex and is linked to a longer structural length to achieve the required low temperatures in the region of the seal.

According to the disclosure, a two-part feedthrough is used, the outer end of which, as known, is implemented by a niobium pin or a niobium-like material. This means a material, the thermal coefficient of expansion of which is in the range of 6 to 9*10-6 l/K and is high-temperature stable. In particular rhenium and tantalum are suitable here instead of niobium or alloys based thereon. It is fused in a way known per se in a short capillary at the end of the discharge vessel by means of solder. The electrode, which is attached at the front on the feedthrough, is based on a shaft made of tungsten, as is known per se. It has a head, which has a sphere or a coil, as also previously known.

It is novel that the feedthrough has a short front part, which is manufactured from iridium. It is preferably a sphere, which approximately has the diameter of the pin, which is attached thereon at the rear.

The front part is preferably shaped spherically and in particular is either formed as a sphere, or is formed to be dumbbell-like from two or more spheres placed one on the other, or in particular a sphere or dumbbell having a pin-like attachment. In this manner, on the one hand, a higher consumption of the costly material iridium is avoided and, on the other hand, the processing of the material iridium, which is difficult to process, is reduced to a minimum. The sphere shape is also preferable for thermal reasons. A seal having a spherical thickening in the region of the feedthrough for reasons of acoustic resonance operation is previously known from DE 102007045071.

The part of the feedthrough which is manufactured from niobium or niobium-like material, and at least a subregion of the front part made of iridium, is sealed using a high-temperature solder. This is a solder known per se, see, for example, WO 2005/124823 or also the iridium-containing solder disclosed in WO 2003/096377. A preferred embodiment is a solder which contains oxides of aluminum and of at least one rare earth metal, such as dysprosium. In particular, it is a eutectic mixture, which may also be designated as a high-temperature frit.

The feedthrough is welded in each case to the electrode.

Preferably at least the hemisphere of the front part of the feedthrough which faces toward the niobium pin is overlapped using the solder or the frit.

However, the solder can also overlap a larger region of the front part.

A plurality of spherical parts can also be concatenated for the front part of the feedthrough. The spherical parts are preferably connected to one another via crest fusion.

The discharge vessel is preferably manufactured from aluminum oxide, such as PCA (polycrystalline alumina), inter alia, as is known per se. It may have integral ends or also separate plugs. Instead of niobium, another material which behaves similarly can also be used, in particular tantalum or rhenium or a material, the thermal coefficient of expansion of which differs by less than 20% from that of niobium, with respect to a temperature of 1100 K. A cermet can optionally also be used. These materials are referred to in summary as niobium material.

An unsaturated filler is preferably used as a filler, which thus passes completely into the vapor phase in operation.

A wattage of 70 W to 150 W is typical, wherein the lamp displays high stability and good dimming properties. An iridium wire as a front part may be sintered directly into the capillary. However, the service lives heretofore implemented therewith are still too short for commercial application.

A front part, which is equipped with a short iridium pin attached to a sphere or a dumbbell, is preferred. This results in stabilization of the alignment of the feedthrough. The key here is to lengthen the fusion length of the glass solder up to the iridium pin. If an unsaturated mercury-free filler is used, frits of the type aluminum oxide/thulium oxide/aluminate and aluminum oxide/yttrium oxide have proven themselves particularly well. The fusion is performed, for example, by means of IR laser or tungsten coil heater.

The spherically shaped front part made of iridium is the key to keeping a high-temperature seal tightly sealed for a long time under application of temperatures of at least 1550° C.

The discharge vessel is preferably shaped to be bulbous, oval, elliptical, barrel-shaped, or similar to a rugby ball, and has in particular a high aspect ratio of at least 2. The novel sealing technology typically allows a shortening of the structural length of the discharge vessel with respect to the conventional capillary seal by 30% to 60%.

Typical fillers contain NaI, CaI2, and rare earth metals such as in particular CeI3 and optionally PrI3 and also ErI3. These also include, for example, HgI2, TlI, and optionally MnI2. Other halogens such as chlorine or bromine are also suitable for the halides.

In the case of mercury-free lamps, in particular ZnI2, InI, TlI, NaI, and REI3 are used in a mixture as filler, RE standing for rare earth metal here. In particular xenon is used alone or in combination with other noble gases, in particular argon, as a noble gas.

A high-pressure discharge lamp including a discharge vessel is disclosed, which encloses a discharge volume, wherein a filler is housed in the discharge volume, wherein the discharge vessel is equipped with an end which is tubular, in particular a capillary, and in which a two-part feedthrough is sealed by means of glass solder, wherein an electrode is attached to the feedthrough, which protrudes into the discharge volume, characterized in that the feedthrough is composed of a front part and a rear part, wherein the rear part is manufactured from niobium material and the front part is manufactured from iridium.

In a further embodiment, the high-pressure discharge lamp is configured that the front part is formed to be hemispherical in the direction toward the rear part, and in particular the front part is formed to be substantially sphere-like.

In a still further embodiment, the front part is formed to be a sphere or a concatenation of a plurality of spheres or to be a sphere having pin attachment.

In a still further embodiment, the glass solder extends from the end of the tube up to at least a subregion of the front part.

In a still further embodiment, the glass solder extends at least up to a hemispherical subregion of the front part facing toward the rear part.

In a still further embodiment, the glass solder is a high-temperature solder based on oxides of aluminum, in particular with the inclusion of aluminates, and the rare earth metals.

In a still further embodiment, the filler includes metal halides.

In a still further embodiment, the filler includes mercury.

In a still further embodiment, the diameter of the front part transversely to the lamp axis is in the range from 0.35 mm to 1.2 mm, and in particular is at least 0.5 mm.

In a still further embodiment, the axial length of the fusion zone is between 0.5 mm and 4 mm, in particular at least 0.8 mm.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
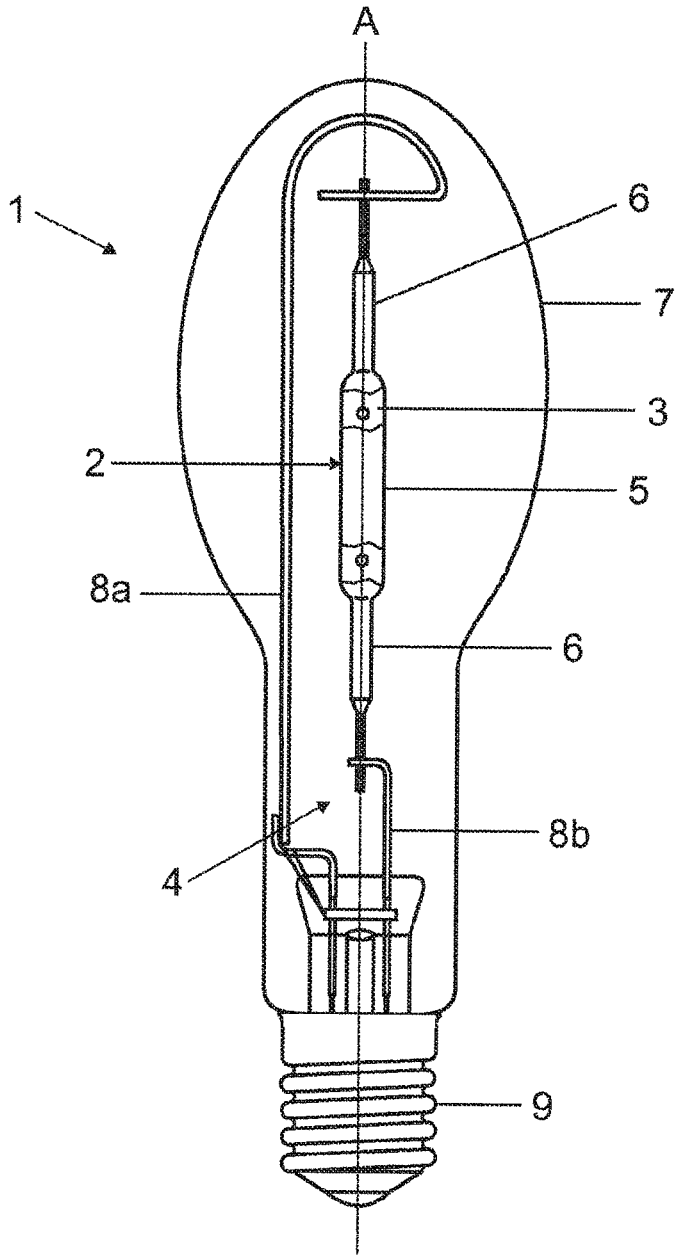
FIG. 1 shows a high-pressure discharge lamp having discharge vessel having separate external bulb.

FIG. 1 schematically shows a metal halide lamp 1. It consists of a discharge vessel 2 made of PCA, into which two electrodes 3 are inserted. The discharge vessel has a central part 5 and two ends. Two short capillaries or tube parts 6 are seated on the ends. The lamp has a longitudinal axis A.

The discharge vessel 2 is enclosed by an external bulb 7. The discharge vessel 2 is mounted in the external bulb by means of a frame, which includes a short and a long power supply line 8*a* and 8*b*. A screw base 9 is seated on the external bulb.

The discharge vessel contains a filler, which typically includes mercury (3 to 30 mg/cm$^3$) and 0.1 to 1 mg/cm$^3$ metal halide. Argon at a pressure of 30 to 300 hPa cold is typically used as a noble gas.

Figure 2:
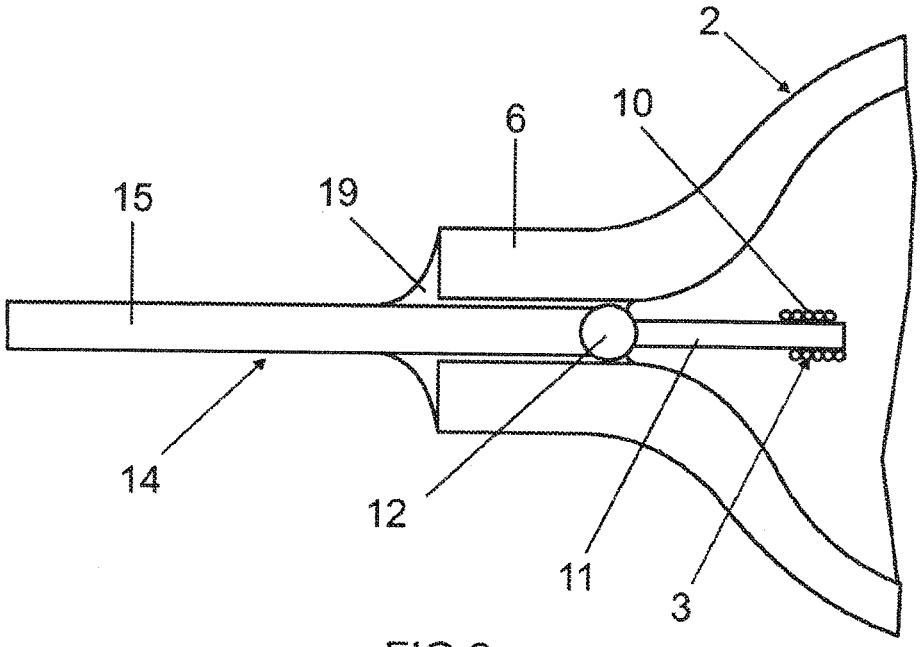
FIG. 2 shows a first exemplary embodiment for the region of the seal at one end.

FIG. 2 shows a first embodiment of the region of the seal at one end 6. The electrode 3 with a head, which is implemented as a coil 10, and a shaft 11 made of tungsten, is attached to a sphere 12 made of iridium and welded thereon by means of laser. The sphere is the front part of a feedthrough 14. The rear part of the feedthrough is a pin 15 made of niobium. The rear part is welded onto the front part 12. A high-temperature solder 19, preferably a eutectic mixture made of aluminum oxide and Dy2O3 or other rare earth metals, is poured into the capillary, which forms the end 6. It extends from the outside up to the sphere 12 and extends thereon at least up to the equator of the sphere, transversely to the axis A of the lamp.

Instead of niobium, another niobium-like material can also be used for the rear part, in accordance with the following Table 1. Four metals are compared with PCA therein. The thermal coefficient of expansion TCE at an operating temperature of 1130 K and the percentage difference from niobium are specified.

| | T (K) | TCE (1/K) | Delta to niobium TCE (%) |
|---|---|---|---|
| Metal | | | |
| Rhenium | 1130 | 6.6E−06 | 17.5 |
| Iridium | 1130 | 7.4E−06 | 7.5 |
| Tantalum | 1130 | 7.0E−06 | 12.8 |
| Niobium | 1130 | 8.1E−06 | 0.0 |
| Comparison: | | | |
| Al2O3 | 1130 | 8.1E−06 | −0.4 |

Figure 3:
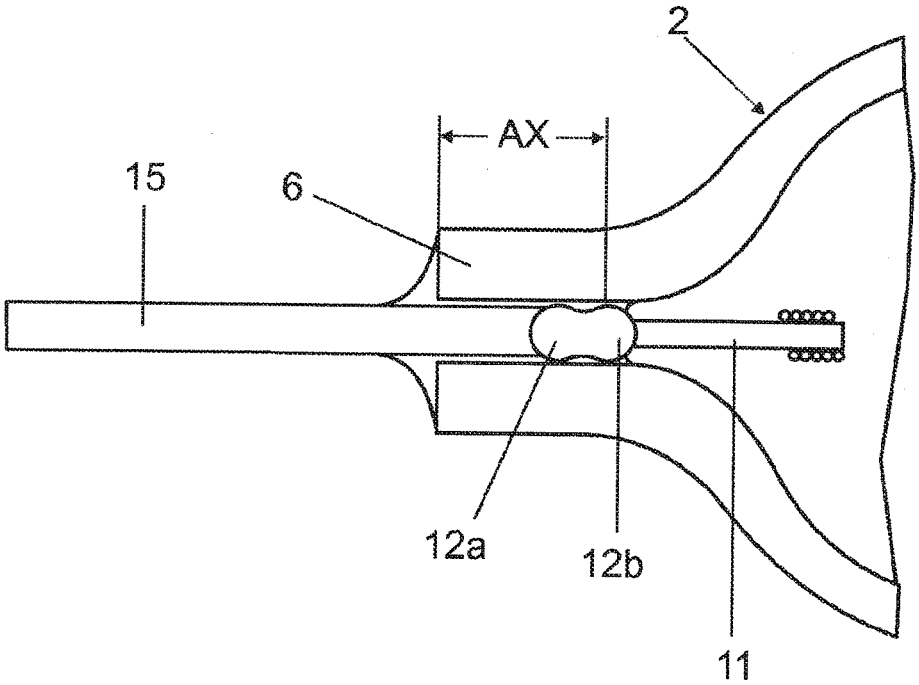
FIG. 3 shows a second exemplary embodiment for the region of the seal at one end.

FIG. 3 shows a further embodiment, in which the front part of the feedthrough consists of two spheres 12*a*, 12*b* attached to one another, which are connected to one another via crest fusion. The touching crests of two spheres are fused during welding.

The spheres are in particular approximately as wide in the transverse dimension thereof as the diameter of the rear part 15. The diameter of the shaft 11 of the electrode, in contrast, is conventionally somewhat smaller, specifically in an order of magnitude of typically 20-30% or matching with the wattage of the high-pressure discharge lamp.

Figure 4:
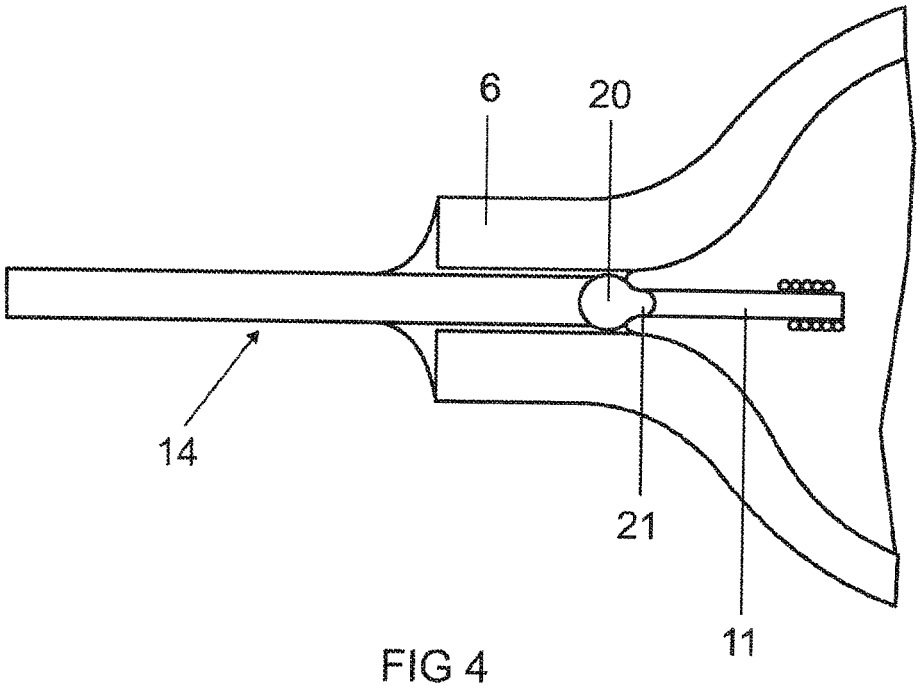
FIG. 4 shows a third exemplary embodiment for the region of the seal at one end.

FIG. 4 shows a further embodiment, in which the front part of the feedthrough consists of a sphere 20, onto which a pin attachment 21 is formed in the direction toward the shaft, the transverse dimension of this pin attachment approximately corresponding to the diameter of the shaft 11 and preferably being at most 10% to 20% larger. The longitudinal dimension of the pin attachment 21 is conventionally 30% to 70% of the diameter of a sphere 20.

Typical diameters for the spheres 12, 20 are 0.3 mm to 1.2 mm. The value is dependent on the wattage of the lamp. For a typical 100 W lamp, a typical value of the diameter of the sphere is 0.7 mm.

The length of the fusion zone AX, i.e., the axial region in which the solder extends at least into the capillary, is typically 0.8 mm to 4 mm. A typical value for a 100 W lamp is 1.5 mm to 2.5 mm.

The frits typically consist of mixtures of various rare earth oxides such as Dy2O3 together with aluminum oxide, wherein aluminates, for example, $Dy_2Al_5O_{12}$ may be admixed. Furthermore, small proportions of $SiO_2$ can also be admixed, a proportion of 1% to 15% is typical.

The proposed sealing technology is suitable both for mercury-containing fillers and also for mercury-free fillers.

The filler typically contains iodides of sodium, cesium, thulium, dysprosium, and/or thallium and also of calcium. Metal halides of other metals are not precluded, of course.

An upper limit for the transverse dimension of the spheroid front part is 1.2 mm, if this is based on a power up to 1000 W. An application for powers between 20 W and 400 W, in particular 75 W to 150 W, is typical.

The feedthrough system having the iridium-containing front part is well suitable in particular for wattages from 150 W to 1000 W.

A particular advantage of the novel closure technology is that it can be introduced on standard production machines. The sealing is performed by means of closing by laser irradiation.

While the disclosed embodiments has been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A high-pressure discharge lamp comprising:

a discharge vessel enclosing a discharge volume and being equipped with an end which is tubular;

a feedthrough comprising a front part and a rear part, the feedthrough being sealed in the end of the discharge vessel by means of glass solder;

an electrode having a shaft attached to the front part of the feedthrough, the electrode protruding at least partially into the discharge volume;

a filler housed in the discharge volume;

wherein the rear part of the feedthrough is coupled to the front part; and wherein the rear part is manufactured from niobium material and the front part is manufactured from iridium;

wherein the front part is at least partially spherical;

wherein the diameter of the shaft of the electrode is 20-30% smaller than the diameter of the front part.

2. The high-pressure discharge lamp as claimed in claim 1, wherein the front part is formed to be substantially sphere-like.

3. The high-pressure discharge lamp as claimed in claim 2, wherein the front part is formed to be a sphere or a concatenation of a plurality of spheres or to be a sphere having pin attachment.

4. The high-pressure discharge lamp as claimed in claim 1, wherein the glass solder extends from an end of the tubular end up to at least a portion of the front part.

5. The high-pressure discharge lamp as claimed in claim 4, wherein the glass solder extends at least up to the at least partially spherical portion of the front part.

6. The high-pressure discharge lamp as claimed in claim 1, wherein the glass solder is a high-temperature solder based on oxides of aluminum and rare earth metals.

7. The high-pressure discharge lamp as claimed in claim 1, wherein the filler comprises metal halides.

8. The high-pressure discharge lamp as claimed in claim 1, wherein the filler comprises mercury.

9. The high-pressure discharge lamp as claimed in claim 1, wherein the diameter of the front part transversely to the lamp axis is in the range from 0.35 mm to 1.2 mm.

10. The high-pressure discharge lamp as claimed in claim 1, wherein an axial length of a fusion zone is between 0.5 mm and 4 mm.

* * * * *